US010619444B2

(12) United States Patent
Goff

(10) Patent No.: US 10,619,444 B2
(45) Date of Patent: Apr. 14, 2020

(54) SELF-ALIGNING STUFFING BOX

(71) Applicant: Malcolm Goff, Calgary (CA)

(72) Inventor: Malcolm Goff, Calgary (CA)

( * ) Notice: Subject to any disclaimer, the term of this patent is extended or adjusted under 35 U.S.C. 154(b) by 186 days.

(21) Appl. No.: 15/874,468

(22) Filed: Jan. 18, 2018

(65) Prior Publication Data

US 2018/0202255 A1 Jul. 19, 2018

Related U.S. Application Data

(60) Provisional application No. 62/447,536, filed on Jan. 18, 2017.

(51) Int. Cl.

| | |
|---|---|
| ***E21B 33/08*** | (2006.01) |
| *E21B 34/02* | (2006.01) |
| *E21B 34/00* | (2006.01) |
| *E21B 43/12* | (2006.01) |

(52) U.S. Cl.

CPC ..... *E21B 33/08* (2013.01); *E21B 34/02* (2013.01); *E21B 43/127* (2013.01); *E21B 2034/005* (2013.01)

(58) Field of Classification Search

CPC ..... E21B 33/03; E21B 33/08; E21B 34/02; E21B 43/127; E21B 2021/007

See application file for complete search history.

(56) References Cited

U.S. PATENT DOCUMENTS 1,566,256 A 12/1925 Trout et al.
1,911,670 A * 5/1933 Black ..... E21B 33/08 277/504
1,947,198 A 2/1934 Goble
2,069,443 A * 2/1937 Hill ..... F16J 15/187 277/329
2,179,814 A * 11/1939 Conaghan ..... E21B 33/0422 277/329

(Continued)

FOREIGN PATENT DOCUMENTS

CN 2056443 4/1990

OTHER PUBLICATIONS

International Search Report received in corresponding PCT Application No. PCT/CA2018/050057, dated Apr. 13, 2018, 3 pages.

(Continued)

*Primary Examiner* — David Carroll

(74) *Attorney, Agent, or Firm* — Parlee McLaws LLP; Chi Fai Andrew Lau

(57) ABSTRACT

A self-aligning stuffing box is provided for mounting to a wellhead and aligning with a polished rod extending therethrough. The stuffing box has an upper sealing section housing stuffing box seals and an annular retaining plate for clamping a flange portion of the sealing section to the wellhead. The flanged portion of the sealing section has oversized bolt apertures, allowing it to be laterally displaced relative to the wellhead before being secured to the wellhead. The retaining plate and the wellhead have bolt apertures corresponding to the oversized apertures. The stuffing box can be mounted on a wellhead using a plurality of fasteners. The stuffing box can be aligned with a polished rod by loosening the fasteners and stroking the polished rod to allow the sealing section to be laterally displaced. The fasteners can then be tightened or re-tightened to secure the sealing section to the wellhead.

17 Claims, 8 Drawing Sheets

(56) References Cited

U.S. PATENT DOCUMENTS

| | | | | |
|---|---|---|---|---|
| 3,827,487 | A * | 8/1974 | Jackson | E21B 33/072<br>166/77.3 |
| 4,060,353 | A | 11/1977 | Akimoto et al. | |
| 5,636,688 | A * | 6/1997 | Bassinger | E21B 33/08<br>166/176 |
| 6,394,461 | B1 * | 5/2002 | Henderson | E21B 33/08<br>277/327 |
| 2018/0202254 | A1 * | 7/2018 | McAdam | E21B 33/08 |

OTHER PUBLICATIONS

Written Opinion received in corresponding PCT Application No. PCT/CA2018/050057, dated Apr. 13, 2018, 5 pages.

* cited by examiner

SELF-ALIGNING STUFFING BOX

CROSS-REFERENCE TO RELATED APPLICATIONS

This application claims the benefit of US Provisional Patent application Ser. No. 62/447,536, filed Jan. 18, 2017, the entirety of which is incorporated herein by reference.

FIELD

Embodiments herein relate to wellhead assemblies, and more particularly to self-aligning adjustable stuffing boxes for a wellhead.

BACKGROUND

Conventionally, downhole pumps are actuated using a rod pump, commonly known as a pump jack, which reciprocates a rod string operatively connected to the pump. Alternatively, a rotary pump such as a PC pump can be actuated by rotating the rod string using a rotary drive system at surface.

Stuffing boxes are commonly positioned on wellheads having such pumps to create a seal between the wellhead and rod string, or other wellbore tubulars, extending therethrough in order to retain fluid pressures therebelow and prevent the leakage of wellbore fluids past the stuffing box to the environment.

Typically, the stuffing box is positioned to secure around the uppermost rod of a plurality of connected rods forming the rod string, referred to as the polished rod. In order to create a seal with the polished rod and allow the rod to reciprocate through, or rotate in, the stuffing box without being damaged, one or more seals, such as packing rings, are positioned within the stuffing box and concentrically disposed around the rod. Such designs are successful when the polished rod is axially aligned and concentric with the bore of the stuffing box. However, for various reasons, the polished rod can be out of alignment with the stuffing box bore and apply a side-load to the seals therein, consequently causing excessive wear to the packing rings and/or the rod with a resultant leak thereby. For example, the polished rod can become misaligned due to settling of the pumpjack or rotary drive on a base, or misalignment of the wellhead and/or stuffing box during assembly. In extreme cases of wear, the polished rod can weaken and fail and the remaining rod string can drop into the wellbore, leaving the wellbore dangerously open to the surface. Further, retrieval of a dropped rod string from the wellbore can be time consuming and costly.

Often, stuffing boxes provide a safety valve for closing off the wellbore from surface in the catastrophic event of breakage of the polished rod. Known valves typically comprise a movable portion such as a flapper that is pivotally mounted in the bore of the stuffing box and biased to pivot from an "open" position, which allows the polished rod to extend there through, to a "closed" position, which effectively seals the surface off from wellbore fluids. Such safety valves are also vulnerable to damage by a misaligned rod, thus introducing the risk of a damaged valve failing to prevent wellbore fluids from escaping to surface in the event of rod failure.

To mitigate damage to stuffing box components caused by a misaligned polished rod, it is known to provide an adjustable stuffing box capable of aligning with a misaligned rod. For example, there exist self-aligning stuffing boxes incorporating two component stuffing boxes with an angular alignment interface. Such units have a first tubular member having a convex face for engaging a concave seat on a second tubular member, forming an alignment aspect therebetween and permitting limited universal angular movement of the first and second members relative to one another for aligning the packing seals with the polished rod therein. Such self-aligning stuffing boxes typically necessitate a relatively tall body to accommodate the alignment aspect, and can only withstand relatively low wellbore pressures compared to non-self-aligning stuffing boxes.

Other designs for adjustable stuffing boxes, such as that described in U.S. Pat. No. 5,711,533 to Angelo et al, employ a flanged connection between an upper sealing section and a lower wellhead mounting section, such flanged connection having oversized bolt holes and oversized washers to allow the upper section to be displaced laterally relative to the lower section so as to align with the polished rod and alleviate side loading on the stuffing box seals therein. While such stuffing boxes provide reduced height and better high pressure performance due to the otherwise flanged interface, they can be problematic as the range of lateral adjustment of such boxes is limited by the size of the bolt holes. An increase in the size of bolt holes necessitates an increase in flange size, washers, and/or bolt heads to accommodate the larger bolt holes, perhaps requiring non-traditional washers or bolts which may be more expensive and/or difficult to replace. Eventually, too great a disparity between bolt and hole diameters may adversely affect the stability of the stuffing box assembly.

Additionally, many existing adjustable stuffing boxes merely rely on the stuffing box seals to forcibly align the polished rod with the stuffing box, which puts significant side loads on the seals and can cause premature wear thereto.

Further, existing procedures for aligning an adjustable stuffing box with a polished rod involve approximating the position of the stuffing box where it might be best aligned with the polished rod. Such an alignment procedure is inaccurate and may result in the unwanted side-loads.

There is a need for an adjustable stuffing box capable of self-alignment with a misaligned polished rod that has a low profile, is capable of withstanding high pressures, can be readily aligned without subjecting the stuffing box seals to excessive side loads, and can be used with commonly available components. Further, it would be ideal to accommodate or equip the stuffing box with a safety valve for sealing the wellbore in the event catastrophic failure of the rod occurs.

SUMMARY

Generally, a self-aligning stuffing box is provided having an upper sealing section and an annular retaining plate. The stuffing box can be mounted directly onto the wellhead, or connected to a lower section which is mounted onto the wellhead. The laterally adjustable upper sealing section has upper bore for aligning the seals of the stuffing box therein to a polished rod extending therethrough. The lower section has a lower bore for receiving the polished rod therethrough. The retaining plate fits about a neck portion of the sealing section. The retaining plate and lower section/wellhead have corresponding bolt apertures sized for the pressure service of the wellhead. The a flange portion of the sealing section has oversized apertures corresponding to the bolt apertures of the retaining plate and lower section/wellhead that are not subject to the same tensile pressure conditions. To couple the sealing section to the lower section/wellhead, a flanged portion of the sealing section can be clamped between the retaining plate and lower section/wellhead by inserting a plurality of stud-and-bolt fasteners through the plurality of corresponding bolt apertures of the retaining plate, flanged portion, and lower section/wellhead, and tightening the fasteners. The apertures of the flanged portion of the sealing section are enlarged to allow the sealing section, when not yet clamped or secured, to be laterally displaced relative to the lower section/wellhead to align the stuffing box seals therein with a misaligned rod.

The stuffing box can be aligned with a misaligned polished rod by loosening the fasteners sufficiently to allow the sealing section to be laterally displaced relative to the lower section. The polished rod can then be stroked to allow the sealing section to shift under lateral forces of the rod therethrough, such that an axis of its bore generally aligns with the axis of the rod. In aligning with the axis of the rod, the axis of the sealing section can be offset from the axis of the bore of the lower section. The fasteners can then be tightened or re-tightened to secure the sealing section to the lower section in the new alignment.

One or more annular bushings can be located in the upper bore to constrain the alignment of the polished rod when the sealing section is secured against lateral displacement, assist in aligning the sealing section with a misaligned rod when the sealing section is permitted to be laterally displaced, and bear at least some of the lateral loading from the rod to protect the stuffing box seals.

In a broad aspect, self-aligning adjustable stuffing box for receiving a wellbore tubular from an oil and gas well can comprise a generally tubular sealing section having a neck portion, a first flanged portion, an upper bore extending axially therethrough, and at least one sealing element located in the upper bore for sealing with the wellbore tubular, the first flanged portion having a first plurality of circumferentially spaced apertures; a retaining plate having a central opening for receiving the neck portion and a second plurality of apertures corresponding to the first plurality of apertures; and a plurality of fasteners for inserting through the first and second pluralities of apertures and sealingly securing the first flanged portion of the sealing section between the retaining plate and a lower wellhead component; wherein the first plurality of apertures and the central opening are oversized to allow the first flanged portion to be at least laterally displaced relative to the lower wellhead component before being secured thereto by the plurality of fasteners.

In an embodiment, the lower wellhead component is a generally tubular lower section having a lower bore extending axially therethrough and a third plurality of apertures corresponding with the first and second pluralities of apertures.

In an embodiment, the first plurality of apertures are box threads formed in a first sealing face of the lower section.

In an embodiment, the first plurality of apertures are throughbores formed through a second flanged portion of the lower section.

In an embodiment, the lower bore has a diameter greater than a diameter of the upper bore.

In an embodiment, the adjustable stuffing box further comprises two or more annular bushings housed within the upper bore for constraining an alignment of the wellbore tubular.

In an embodiment, each of the two or more bushings have an axial extent.

In an embodiment, the two or more bushings are made of a material that is softer than that of the wellbore tubular but harder than that of the at least one sealing element.

In an embodiment, the two or more bushings are axially spaced.

In an embodiment, the at least one sealing element is located intermediate the two or more bushings.

In an embodiment, the first plurality of apertures are circumferentially closed.

In an embodiment, the first plurality of apertures are slots extending radially inward from a peripheral edge of the first flanged portion.

In another broad aspect, a method of aligning the self-aligning adjustable stuffing box of claim 1 with a wellbore tubular can comprise loosening a plurality of fasteners to allow a sealing section to be laterally displaced relative to a lower section; stroking the wellbore tubular to laterally displace the sealing section such that it is axially aligned with the wellbore tubular; and tightening the plurality of fasteners to secure the sealing section.

In another broad aspect, a method of aligning an adjustable stuffing box to a wellbore tubular can comprise arranging a sealing section having a flanged portion to a wellhead; passing a wellbore tubular through the sealing section and through the wellhead; stroking the wellbore tubular; and sandwiching the flanged portion of the sealing section to the wellhead with a retaining plate.

DESCRIPTION

According to embodiments herein, a stuffing box is provided for use in a variety of oilfield applications for sealing wellbore tubulars extending therethrough, such as a polished rod. The stuffing box is capable of adjusting laterally to align with axially misaligned tubulars to alleviate side loading on the stuffing box seals and resulting wear on the seals and tubular. Although the present stuffing box is described in connection with reciprocating rods passing through and moving relative to the stuffing box, alternative embodiments of the present stuffing box may be configured to receive a rotating rod, for example by providing appropriate seals. It should be understood that reference to terms such as "upper"

and "lower", "uphole" and "downhole", and the like are relative terms for explanatory purposes only.

Figure 1:
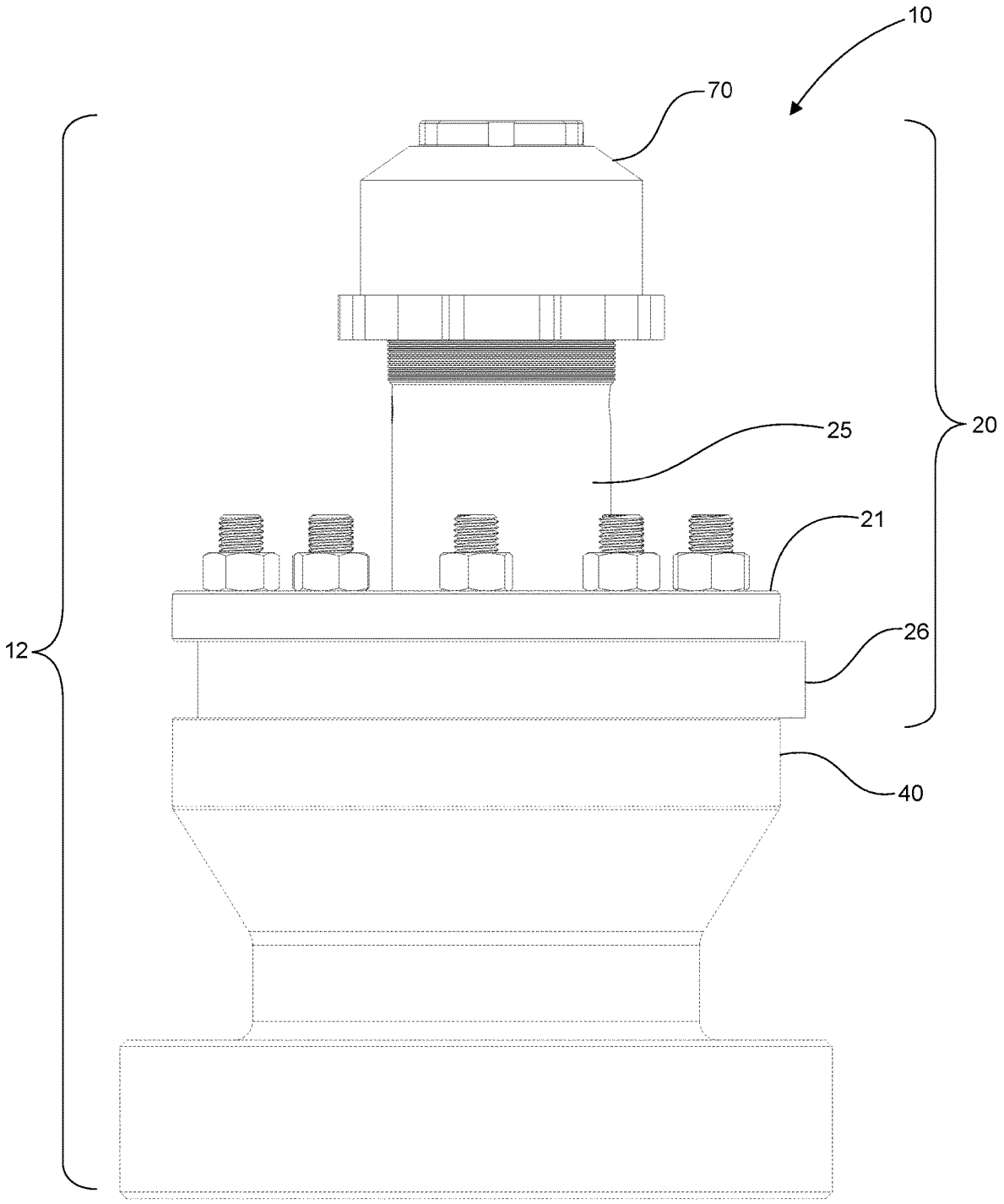
FIG. 1 is a side view of an embodiment of a self-aligning stuffing box with a stuffing box adapted to a misaligned polished rod (not shown)

With reference to FIG. 1, in an embodiment, an adjustable stuffing box 10 is provided as one component of a generally tubular body 12 for connection directly or indirectly to a wellhead therebelow. Body 12 may be removably attached to the wellhead via any means known in the art, such as a threaded or flanged connection.

With reference to FIG. 1, the stuffing box 10 comprises at least an uphole sealing section 20 and an annular retainer plate portion 21 for securing the sealing section 20 to a wellhead directly or to a lower section 40 which connects to the wellhead. The sealing section 20 has an upper neck portion 25 and a lower flanged portion 26. The retaining plate 21 fits about the neck portion 25 for effecting securement of the flanged portion 26 of the sealing section 20 to the lower section 40 or wellhead against well pressure. In embodiments herein, reference will be made to a stuffing box 10 having a lower portion 40. However, one of skill in the art would understand that a downhole wellhead component can be used in place of lower section 40 and incorporate the same features thereof. As such, lower portion 40 is shown with dotted lines in FIG. 1 to indicate that the particular form of component could be omitted if a downhole wellhead component has appropriate structure to couple with sealing section 20 and retaining plate 21.

Figure 2A:
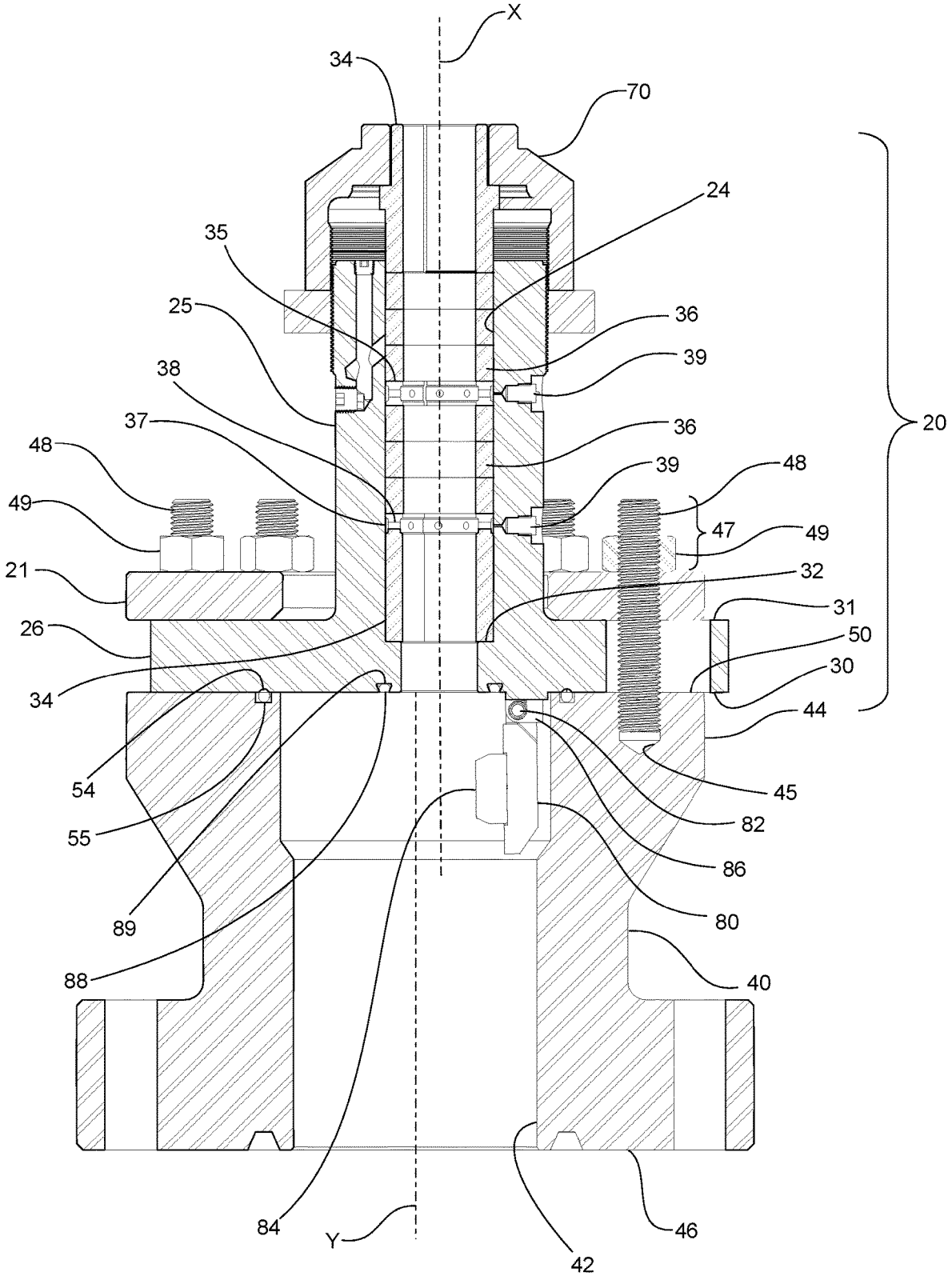
FIG. 2A is a side cross-sectional view of the embodiment of FIG. 1, depicting a flanged portion of a sealing section clamped between, and axially offset from, a retaining plate and a lower section, with a safety valve shown in an open position as it would be so positioned by a polished rod (not shown)

With reference to FIG. 2A, the sealing section 20 has an axial upper bore 24 extending therethrough with a first axis X, the lower section 40 has an axial lower bore 42 with a second axis Y. Seals 36 for retaining well pressure, such as circumferential seals or packing rings, and annular bushings 34 for constraining alignment of the rod and bearing lateral load from a misaligned rod, can be housed within the upper bore 24.

Sealing section 20, lower section 40, and retaining plate 21 are secured together by a plurality of fasteners 47 (studs 48 and nuts 49) the diameter, strength, and length of which correspond with respective apertures 28,45,23 thereof. The apertures 28 of the flanged portion 26 are enlarged relative to the diameters of the studs 48, and a central opening 22 of the retaining plate 21 is enlarged relative to the diameter of the neck portion 25, such that the sealing section 20 can be laterally displaced relative to the lower section 40 when fasteners 47 are not yet tightened. Thus, stuffing box 10 is capable of self-aligning to a misaligned rod by loosening the fasteners 47, stroking the polished rod, allowing the sealing section 20 to be axially aligned with the polished rod, and tightening the fasteners 47 to secure sealing section 20 in the new position.

Figure 2B:
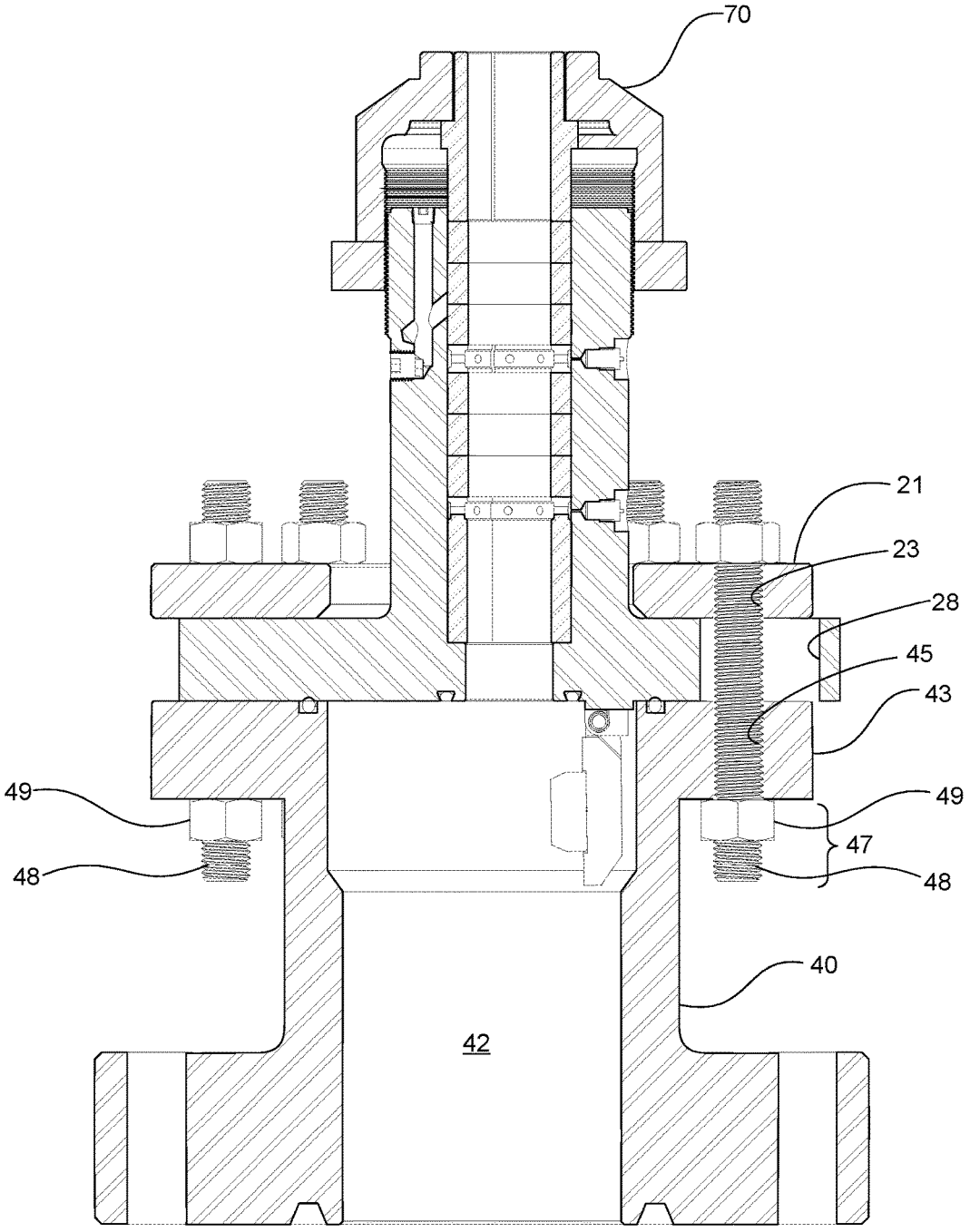
FIG. 2B is a side cross-sectional view of an alternative embodiment of a self-aligning stuffing box wherein an upper end of the lower section is flanged.
Figure 7:
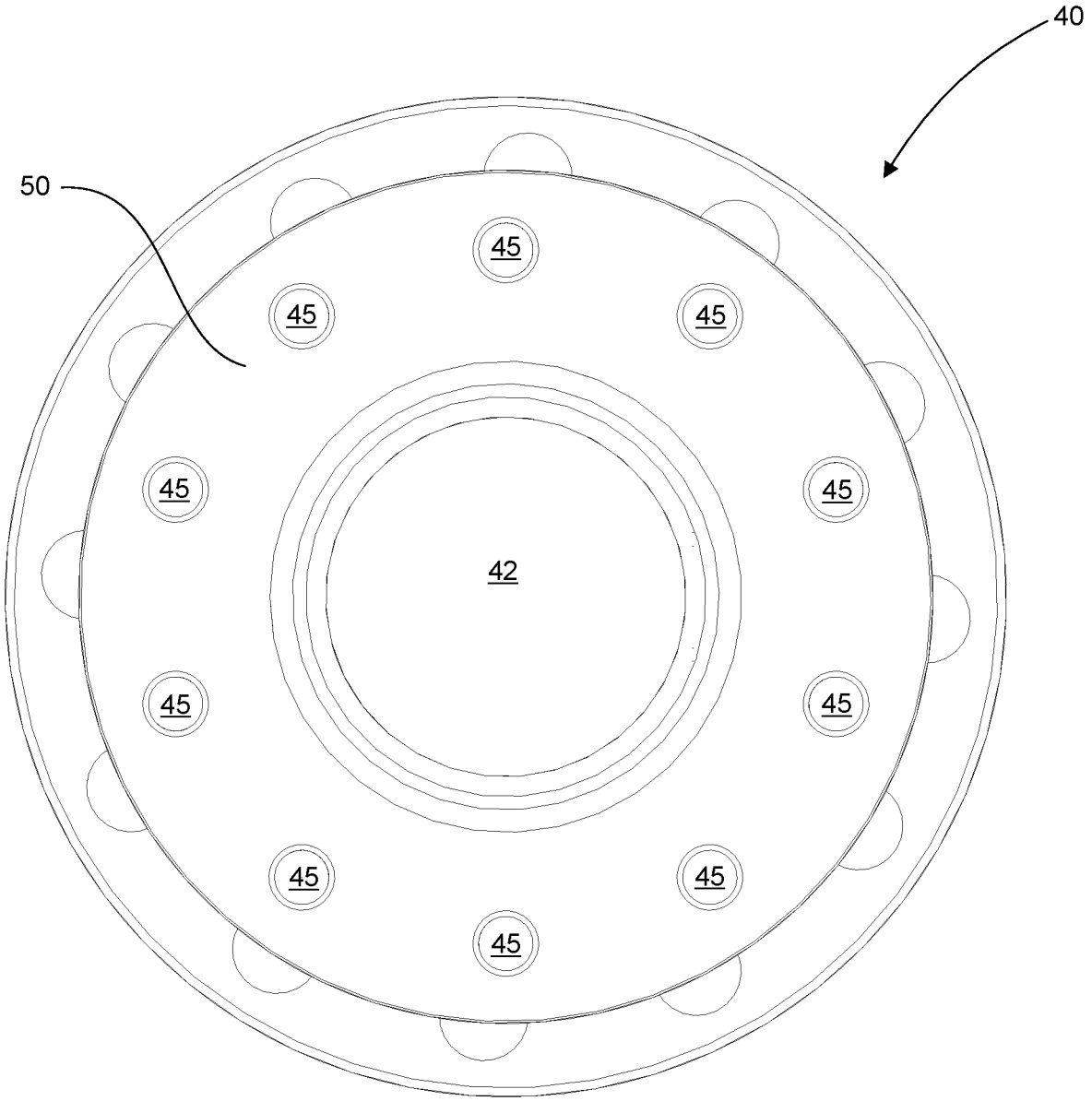
FIG. 7 is a top plan view of the lower section of the stuffing box illustrated the correctly-sized apertures for the fasteners thereof.

In detail, as best shown in FIGS. 2A, 2B, and 7, lower section 40 is a generally tubular member comprising an upper end 44 having upper sealing face 50 for sealingly engaging with a lower sealing face 30 of the sealing section 20, a lower end 46 for connecting the stuffing box 10 to the wellhead, and a lower bore 42 extending axially therethrough. A plurality of radially spaced apertures 45 are formed in the upper sealing face 50 for receiving the plurality of studs 48. In the embodiment depicted in FIG. 2A, the apertures 45 are threaded bores into which studs 48 are threaded such that they axially extend upwardly from the sealing face 50 towards the sealing section 20. In alternative embodiments, with reference to FIG. 2B, upper end 44 can be flanged and apertures 45 can be throughbores formed in the flange for allowing studs 48 to extend therethrough for securement with nuts 49. In embodiments, as shown in FIGS. 2A and 2B, the lower bore 42 can be larger than the upper bore 24 to accommodate significant lateral misalignment of a polished rod therein.

The flanged portion 26 of upper sealing section 20 has a lower sealing face 30 for sealingly engaging with the upper sealing face 50 of the lower section 40 and a retaining face 31 opposite the sealing face 30. A plurality of circumferentially spaced, enlarged apertures 28 corresponding with apertures 45 are distributed about flanged portion 26 for receiving studs 48 therethrough. The enlarged apertures 28 have a diameter larger than that of the studs 48 such that, if not secured in place, sealing section 20 is permitted to be laterally displaced relative to lower section 40 to align with a polished rod, even when studs 48 extend through the apertures 28. As described in further detail below, bushings 34, sealing elements 36, and other components can be housed in upper bore 24, typically in neck portion 25.

At least a first annular groove/seat 55 can be formed in the lower or upper sealing faces 30,50, and be generally concentric with respective bores 24,42. The first annular groove 55 can be configured to receive a first annular or ring seal 54 for providing a sealing engagement between the lower and upper sealing faces 30,50.

Retaining plate 21 is a generally planar annular or ring-shaped member comprising a central opening 22 and a plurality of circumferentially spaced apertures 23 positioned to correspond with the respective apertures 28,45 of the sealing and lower section 20,40 and configured to receive the plurality of studs 48 therethrough. The central opening 22 is oversized to receive the neck portion 25 of the sealing section 20 therethrough and also provide sufficient clearance to permit the sealing section 20 to be laterally displaced relative to lower section 40 before being secured. The size of the fasteners 47 and apertures 45,23 are chosen to be appropriate for the pressure service of the wellhead conditions.

Figure 3:
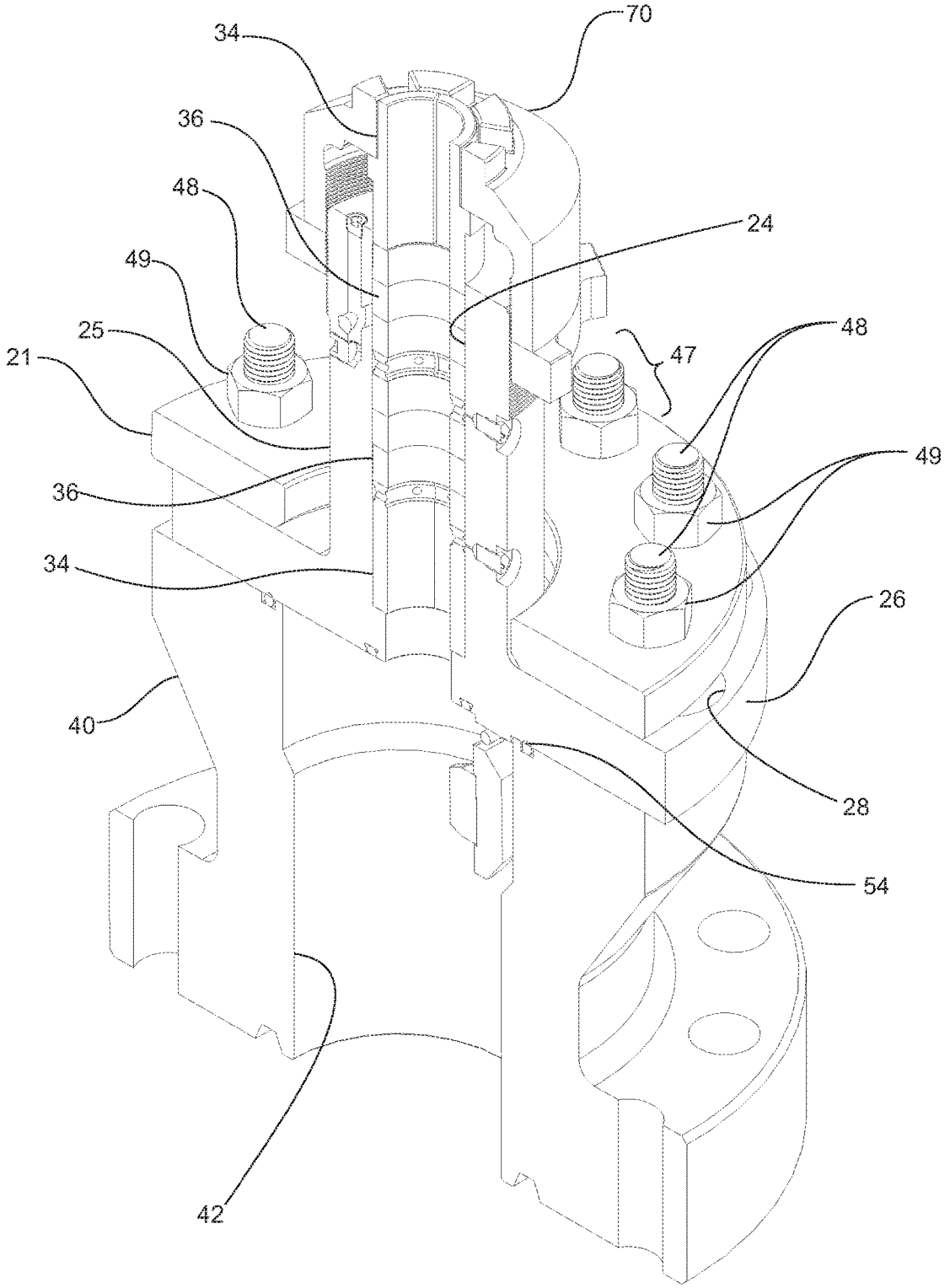
FIG. 3 is a perspective cross-sectional view of the embodiment of FIG. 2A.

To secure the sealing section 20, lower section 40, and retaining plate 21 together, the sealing faces 30,50 of the sealing and lower sections can be brought together, and the plate 21 can be axially slid onto sealing section 20 such that the neck portion 25 extends through the central opening 22 and the plate 21 contacts the retaining face 31 of the sealing section 20. In embodiments wherein studs 48 are first threaded into the apertures 45 of the lower section 40, as shown in FIGS. 1, 2A and 3, the apertures 28 of the sealing section 20 are first aligned with the studs 48 before the sealing and lower sections are brought together, such that the studs 48 extend through apertures 28. Similarly, the apertures 23 of the retaining plate 21 are aligned with the studs 48 such that the studs 48 extend through apertures 23 as the plate 21 is brought into contact with the retaining face 31. In embodiments wherein apertures 45 are formed in lower flange 43, as shown in FIG. 2B, the respective apertures 28,45,23 of the sealing section, lower section, and retaining plate can be aligned and studs 48 inserted therethrough. Nuts 49 can then be threaded onto each end of the studs 48 to drive the plate 21 and lower section 40 towards each other and clamp the flanged portion 26 of the sealing section 20 therebetween, thereby effecting a structural assembly, preventing the sealing section 20 from shifting laterally relative to the lower section 40, and creating a sealing engagement between the first and second sealing interfaces 30,50.

Referring now to FIGS. 2A-3, annular sealing elements 36, such as a plurality of stacked, circumferential seals or packing rings, can be housed in the upper bore 24 and rest on an annular shoulder 32 formed therein for creating a sealing engagement with the polished rod and preventing wellbore fluids from escaping thereby. Generally, annular bushings 34 can also be provided inside the upper bore 24 and configured to receive the polished rod therethrough. Preferably, at least two bushings 34 are provided and are axially spaced, such as by sealing elements 36. The bushings 34 act to constrain the alignment of the polished rod as it passes through the upper bore 24, thereby protecting sealing elements 36 from excessive wear. Additionally, the bushings 34 also assist in aligning the sealing section 20 with the rod when fasteners 47 are loosened sufficiently to allow the sealing section 20 to be laterally displaced, and the rod is reciprocated. Bushings 34 are configured to fit within upper bore 24, have an interior diameter about equal to the polished rod, and preferably have an axial extent so as to better guide the polished rod through the upper bore 24 and protect sealing elements 36.

In embodiments, as best shown in FIG. 2A, one or more of the bushings 34 can have annular grooves 37 with portholes 38 enabling fluid communication between the annular grooves 37 and upper bore 24. Ports 39 can be formed in the sealing section 20 and axially aligned with the annular grooves 37 for permitting fluid communication between the environment and the upper bore 24 via portholes 38. The ports 39 can comprise valves, such as one-way or needle valves, which permit fluids such as lubricant to flow into the upper bore 24 while preventing fluids from flowing out. Additionally, one or more ring-shaped spacers 35 can be located in the bore 24 between adjacent sealing elements 36 and/or between a sealing element 36 and bushing 34 for assisting with laterally constraining the rod. Spacers 35 can also have annular grooves 37 and portholes 38 with corresponding ports 39 in the sealing section 20 for allowing lubricant to be introduced into the bore 24. Bushings 34 and spacers 35 can be made of bronze, brass, or another suitable bushing material that is hard enough to guide the polished rod and withstand side loads without excessive wear, but soft enough to not damage the rod. Preferably, the bushings 34 and spacers 35 are made of a material that is harder than the sealing elements 36 and softer than the polished rod. As one of skill in the art would understand, other configurations of bushings 34, spacers 35, and sealing elements 36 can be implemented besides those depicted.

In embodiments, a cap 70 can be coupled to the sealing section 20, for example via a threaded connection, to retain bushings 34, spacers 35, and sealing elements 36 therein. Cap 70 can be configured to compress the bushings 34, spacers 35, and sealing elements 36 towards the shoulder 32 when tightened, thereby energizing the seals 36 and causing them to seal against the surface of a polished rod extending therethrough. Preferably, cap 70 can be easily removed axially for convenient access to the upper bore 24, such as for performing maintenance or replacing components therein.

In embodiments, as shown in FIGS. 2A and 3, a valve 80, such as a pivotable flapper valve, can be mounted to the lower end of the sealing section 20. In a first "open" position, the flapper valve 80 permits the passage of the rod through the upper bore 24. The flapper 80 is held open by the presence of the rod itself. In a second "closed" position, the valve 80 obstructs the bore 24 to prevent wellbore fluids from flowing past the valve 80. Flapper valve 80 can be biased from the open to the closed position by a biasing element 82, such as a spring, such that, in the event of a failure of the rod wherein the rod leaves the upper bore 24, the valve 80 is biased closed and prevents the expulsion of wellbore fluids. A stopper or bushing 84 may be mounted to valve 80 to contact the rod in order to minimize wear to the rod. The stopper or bushing 84 may be manufactured from any bushing material for minimizing damage to the metal rod. When in the closed position, valve 80 can be sealingly engaged with the upper sealing face 30 sealing section 20 via a second ring seal 88 nested within a second annular groove or seal seat 89 formed in the sealing face 30. In other embodiments, second annular seal 88 and second annular groove 89 can be located on the body of the valve 80.

In one embodiment, valve 80 may be secured to the sealing section 20 via at least one fastener such as a pin or screw. Alternatively, a fixed portion of valve 86 may be formed integrally with sealing section 20, as best shown in FIG. 2. In alternative embodiments, a valve 80 other than a flapper valve, such as a ball valve, can be used.

In use, when a polished rod has become misaligned, the stuffing box 10 can be adjusted to conform to the misaligned rod by loosening fasteners 47 until sealing section 20 is capable of being laterally displaced relative to lower section 40. The stroking of the misaligned rod will aid in displacing the movable sealing section 20 laterally such that its axis X generally aligns with the axis of the rod, thus providing the self-aligning aspect of the stuffing box 10. After the sealing section 20 has been aligned with the misaligned rod, the fasteners 47 can be re-tightened to re-secure sealing section 20 between lower section 40 and retaining plate 21. The alignment procedure described above typically does not require any manual input besides the loosening of the fasteners 47 and stroking of the polished rod. The bushings 34 inside upper bore 24 assist in aligning the sealing section 20 with the rod while protecting sealing elements 36 from side loads applied by the stroking of the rod. When fasteners 47 have been re-tightened, the bushings 34 again aid in constraining alignment of the polished rod within the upper bore 24 and within a sealing tolerance of the sealing elements 36.

As mentioned above, in alternative embodiments, the stuffing box 10 can comprise only the sealing section 20 and retaining plate 21, which mount directly onto a wellhead component. In such embodiments, the apertures 28,23 of the sealing section 20 and plate 21 correspond to, and are aligned with, the apertures 45 of the wellhead component, and fasteners 47 are inserted therethrough to secure the stuffing box 10 to the wellhead component. The sealing section 20 and retaining plate 21 can be secured to the wellhead component via fasteners 47 in a manner similar to that described above. Such an embodiment saves space and results in a shorter wellhead height, but also may not provide as much bore clearance to accommodate the deviation of a misaligned rod as would be achieved by using the enlarged lower bore 42 of lower section 40 of the earlier described embodiment. This can be addressed by providing a wellhead component with an enlarged axial bore for connection to the stuffing box 10.

As shown in FIG. 5B, in an alternative embodiment, apertures 28 can be a plurality of slots extending radially inward from a peripheral edge of the flanged portion 26 as opposed to circumferentially closed openings.

It is an advantage of the present stuffing box 10 that the stuffing box can have a relatively high pressure rating compared to other self-aligning or adjustable stuffing boxes. For example, in embodiments, the present stuffing box 10 can have a pressure rating of 10,000 to 15,000 psi, taking into account a safety factor of 1.5, when using 4140 HTSR steel for the sealing section 20, lower section, retaining plate 21, and cap 70 and ⅞"-9 Stud×4¾" Lg. studs. Conventional adjustable stuffing boxes typically have pressure ratings of 3,000 to 5,000 psi.

Additionally, bushings 34 control the alignment of the polished rod after the stuffing box has been adjusted, and bear much of the lateral load if the rod becomes somewhat misaligned, which is advantageous compared to conventional stuffing boxes in which the seals 36 bear most or all of the side load, resulting in accelerated seal wear and possible failure.

Figure 4:
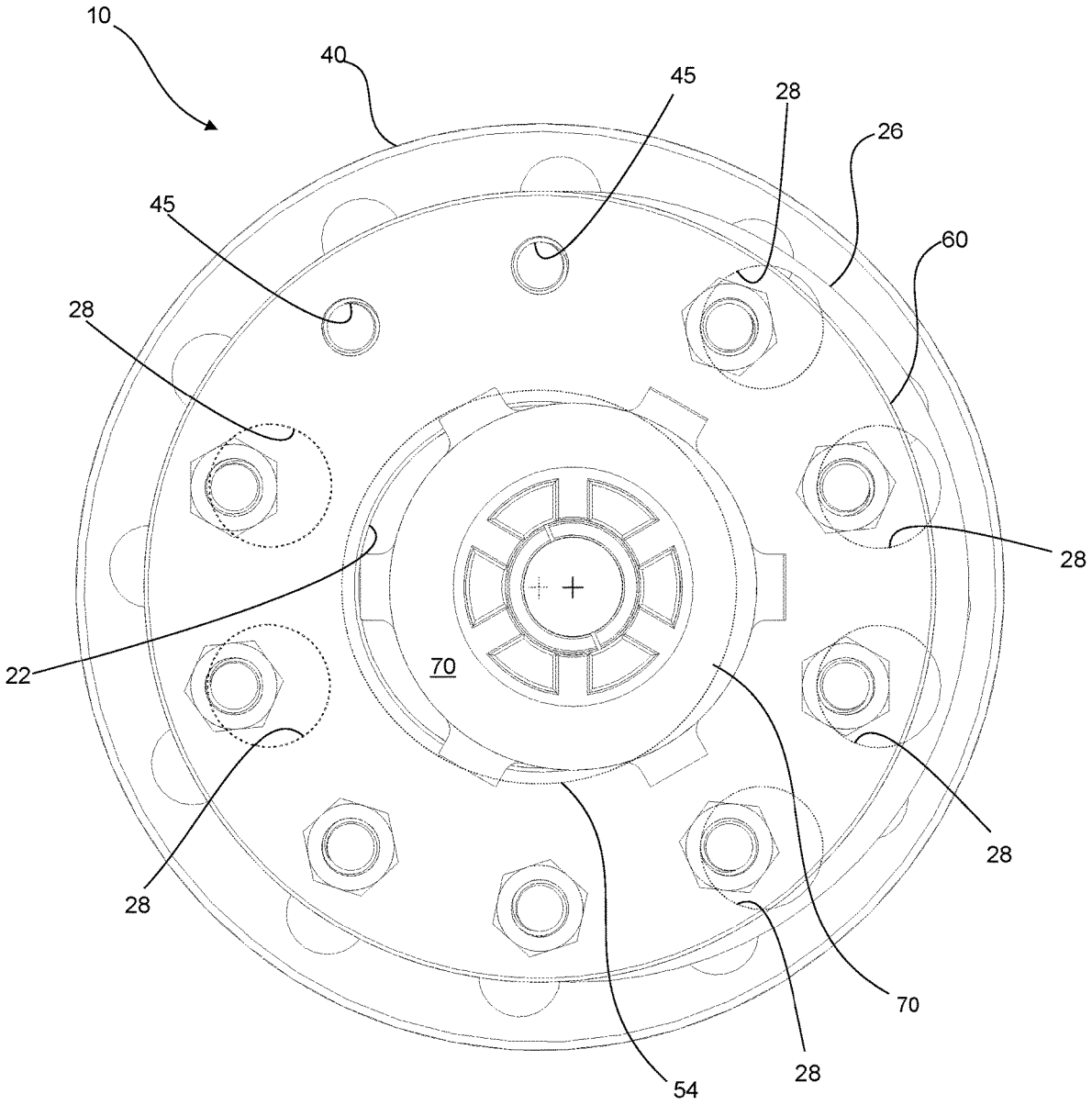
FIG. 4 is a top plan view of the embodiment of FIG. 2A.
Figure 5:
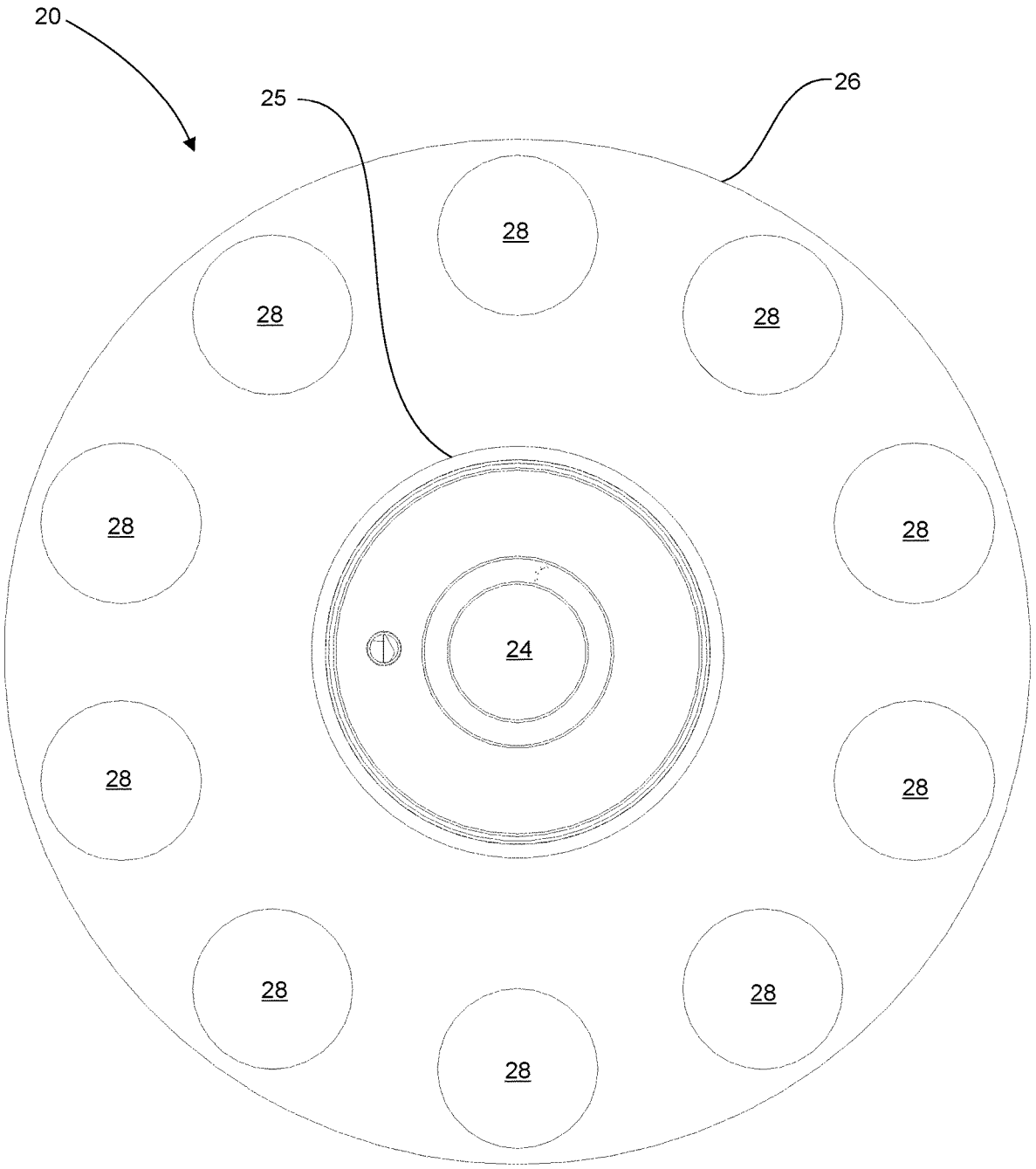
FIG. 5 is a top plan view of the sealing section of the embodiment of FIG. 1 for illustrating the enlarged apertures with some fasteners removed to show the apertures of the retaining plate.
Figure 6:
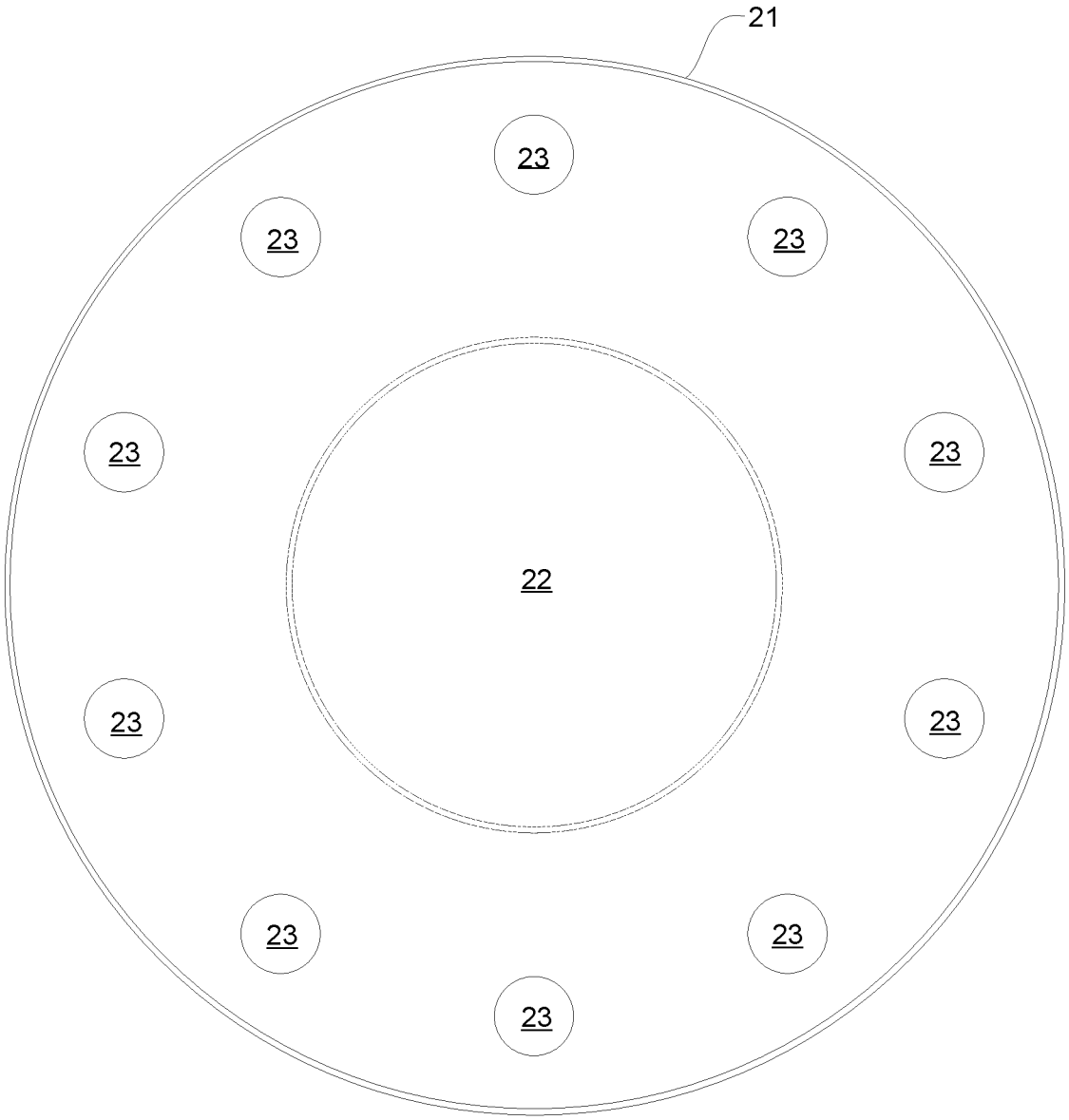
FIG. 6 is a top plan view of the retaining plate illustrating the correctly-sized apertures for the fasteners thereof.

Further, as the respective apertures 23,45 of the retaining plate 21 and lower section 40 are sized to be compatible with commonly available studs 48 and fasteners 47, specialty-sized components are not required to assemble the stuffing box 10. As the enlarged apertures 28 of the sealing section 20 do not directly engage fasteners 47, they can be quite large, as shown in FIG. 5. As shown in FIG. 4, the primary limitation on the size of apertures 28 is that there must be sufficient inner diameter on the flange portion 26 to form the first seal seat 55 for receiving first annular seal 54.

I claim:

1. A self-aligning adjustable stuffing box for receiving a wellbore tubular from an oil and gas well, comprising:

a tubular sealing section having a neck portion, a first flanged portion, an upper bore extending axially therethrough, and at least one sealing element located in the upper bore for sealing with the wellbore tubular, the first flanged portion having a first plurality of circumferentially spaced apertures;

a retaining plate having a central opening for receiving the neck portion and a second plurality of apertures corresponding to the first plurality of apertures; and a plurality of fasteners for inserting through the first and second pluralities of apertures and sealingly securing the first flanged portion of the sealing section between the retaining plate and a lower wellhead component having a third plurality of apertures corresponding with the first and second pluralities of apertures and configured to receive the fasteners;

wherein the first plurality of apertures are enlarged relative to the diameters of the fasteners and the central opening is enlarged relative to the diameter of the neck portion to allow the first flanged portion to be at least laterally displaced relative to the lower wellhead component while the fasteners are inserted through the first, second, and third pluralities of apertures;

wherein the lower wellhead component has a lower bore extending axially therethrough; and wherein the third plurality of apertures are box threads formed in a first sealing face of the lower wellhead component or throughbores formed through a second flanged portion of the lower wellhead component.

2. The adjustable stuffing box of claim 1, further comprising two or more annular bushings housed within the upper bore for constraining an alignment of the wellbore tubular.

3. The adjustable stuffing box of claim 2, wherein each of the two or more bushings have an axial extent.

4. The adjustable stuffing box of claim 2, wherein the two or more bushings are made of brass, bronze or a combination thereof.

5. The adjustable stuffing box of claim 2, wherein the two or more bushings are axially spaced.

6. The adjustable stuffing box of claim 5, wherein the at least one sealing element is located intermediate the two or more bushings.

7. The adjustable stuffing box of claim 1, wherein the first plurality of apertures are circumferentially closed.

8. The adjustable stuffing box of claim 1, wherein the first plurality of apertures are slots extending radially inward from a peripheral edge of the first flanged portion.

9. A method of aligning the self-aligning adjustable stuffing box of claim 1 with the wellbore tubular, comprising:

loosening the plurality of fasteners to allow the sealing section to be laterally displaced relative to the lower wellhead component;

stroking the wellbore tubular to laterally displace the sealing section such that it is axially aligned with the wellbore tubular; and tightening the plurality of fasteners to secure the sealing section.

10. The adjustable stuffing box of claim 1, wherein the lower bore has a second diameter greater than a first diameter of the upper bore.

11. The adjustable stuffing box of claim 1, further comprising a cap configured to couple with the neck portion of the sealing section and axially compress the at least one sealing element.

12. The adjustable stuffing box of claim 1, further comprising a valve located at a lower end of the sealing section, the valve being actuable between an open position for permitting the wellbore tubular to extend thereby, and a closed position for preventing fluid from the well from entering the upper bore.

13. The adjustable stuffing box of claim 12, wherein the valve is a ball valve.

14. The adjustable stuffing box of claim 12, wherein the valve is a flapper valve pivotably mounted to the lower end of the sealing section.

15. The adjustable stuffing box of claim 14, wherein the flapper valve further comprises a stopper for reducing wear to the wellbore tubular due to contact with the flapper valve.

16. The adjustable stuffing box of claim 12, further comprising a spring configured to bias the valve to the closed position.

17. The adjustable stuffing box of claim 10, wherein the lower bore comprises an upper portion and a lower portion, the upper portion having the second diameter and the lower portion having a third diameter smaller than the second diameter.

* * * * *